US012390015B2

(12) United States Patent
Fernández Wyttenbach

(10) Patent No.: US 12,390,015 B2
(45) Date of Patent: Aug. 19, 2025

(54) POSTURE CORRECTOR

(71) Applicant: Alberto Fernández Wyttenbach, Moralzarzal (ES)

(72) Inventor: Alberto Fernández Wyttenbach, Moralzarzal (ES)

( * ) Notice: Subject to any disclaimer, the term of this patent is extended or adjusted under 35 U.S.C. 154(b) by 0 days.

(21) Appl. No.: 18/545,928

(22) PCT Filed: Mar. 2, 2023

(86) PCT No.: PCT/EP2023/055285
§ 371 (c)(1),
(2) Date: Dec. 19, 2023

(87) PCT Pub. No.: WO2023/169917
PCT Pub. Date: Sep. 14, 2023

(65) Prior Publication Data

US 2025/0221540 A1 Jul. 10, 2025

(30) Foreign Application Priority Data

Mar. 11, 2022 (ES) ..... ES202230202

(51) Int. Cl.
*A47C 16/00* (2006.01)
*A47B 97/00* (2006.01)
*A47C 9/00* (2006.01)

(52) U.S. Cl.
CPC ..... *A47C 16/00* (2013.01); *A47B 97/00* (2013.01); *A47C 9/005* (2013.01); *A47B 2200/0085* (2013.01)

(58) Field of Classification Search
CPC ..... A47C 16/00; A47C 9/005; A47B 97/00; A47B 2200/0085
USPC ..... 248/694
See application file for complete search history.

(56) References Cited

U.S. PATENT DOCUMENTS 4,650,249 A * 3/1987 Serber ..... A47C 9/005 248/397
5,022,622 A * 6/1991 Schaevitz ..... A47B 21/0371 248/231.71
5,542,746 A * 8/1996 Bujaryn ..... A47C 9/005 297/301.1
9,402,482 B2 * 8/2016 Miller ..... A47C 16/00
2009/0278391 A1 * 11/2009 Ulrich ..... A47C 7/443 297/283.1
2015/0208800 A1 * 7/2015 Yang ..... A61F 5/00 297/488

* cited by examiner

*Primary Examiner* — Todd M Epps

(57) ABSTRACT

The invention discloses a posture corrector (1) to cause a user sitting in front of a table (100) to adopt a correct posture. The corrector (1) comprises: an elastic support element (2) for the abdomen of the user configured to be provided between an abdomen of the user and a front edge (110) of the table (100); and an attachment means (3) dismountably connected to the support element (2), where the attachment means (3) is configured to attach said support element (2) to the table (100).

4 Claims, 7 Drawing Sheets

POSTURE CORRECTOR

OBJECT OF THE INVENTION

The present invention belongs to the field of the correction of the posture of a person sitting at a table, for example in a working environment such as an office or the like.

The object of the present invention is a very simple posture corrector that is very easy to use irrespective on the type of chair or table used.

PRIOR ART

The slumped shoulders syndrome refers to the tendency to lightly incline the body forward, including the head, bending the back and the shoulders. Bad postures acquired by spending several hours sitting in an office or working remote at home may cause both bones and muscles to get used to this new posture. After all, posture kyphosis is currently growing faster in most developed countries.

To prevent these problems, it is known that the person must sit correctly at the work table: among other requirements, the height of the table must allow the forearms for form approximately 90° when they lie on the table, the shoulders must be straight, the height of the monitor must allow the person to look straight to the front, etc. To ensure this correct posture, a number of solutions have been proposed, such as for example those referred to in the following patent documents.

Document U.S. Pat. No. 4,650,249 discloses an ergonomic chair having a group of elements designed to provide support to several parts of the person. In particular, the chair does not have a back but a support panel for the knees and a second support panel for the chest. In the work posture, the person is slightly inclined forwards, and thereby he/she is forced to maintain a straight back.

Document U.S. Pat. No. 5,542,746 discloses another ergonomic chair also having a support for the knees of the user and another one for the chest area, although in this case the chair additionally has a back. All these elements can be configured in a number of different ways to allow the user to adopt several different postures.

A drawback most known ergonomic chairs have is that the elements used to force the user adopt a correct posture are particular and specific for each chair; this fact rendered a number of excessively complex structures that have never been used in a generalized manner.

DESCRIPTION OF THE INVENTION

The present invention solves the aforementioned problems thanks to a new and very simple posture corrector which can be used with any type of chair. The posture corrector mainly comprises an elastic element that supports the abdomen of the user against the edge of the table he/she is sitting at. To ensure that the elastic element is maintained in the right position, an attachment means attaches said elastic element to the table. Thereby, when the user is sitting at the table, by slightly resting the abdomen against the elastic element the muscles are strengthened and the user is caused to adopt an upright posture.

The present invention is thereby directed to a posture corrector for causing a user sitting at a table adopt a correct posture, that is, un upright posture. This posture corrector mainly comprises a support elastic element and an attachment means. Next, each of these elements is disclosed in further detail.

a) Elastic Support Element

The elastic support element for the abdomen of the user is configured to be placed between the abdomen of the user and a front edge of the table. It is an element having a certain elasticity, thereby slightly deforming in response to the pressure exerted against it by the abdomen of the user. The size of the dimension of the elastic element in the direction of separation between the abdomen of the user and the table may range between 10 cm and 30 cm, more preferably between 15 cm and 25 cm. This distance range ensures a correct distance between the user and the table.

The elastic support element may be configured in a number of different manners. For example, the elastic support element may be a cushion made of an elastic material, such as polyethylene foam or the like. However, preferably the elastic support element is an inflatable element. This is advantageous because these type of elements are by definition elastic at most pressures attainable manually, that is, simply blowing through a suitable valve. Further, inflatable elements are advantageous in that they have a rounded form lacking any sharp edge, thus they naturally provide comfort for the user.

In connection to the shape, the support element may have any shape provided it ensures the user to comfortably rest against it, such as e. g. an spherical or cylindrical shape. In a particularly preferred embodiment of the invention, the elastic support element is an spherical inflatable balloon, for example a balloon having a diameter of between 15 cm and 25 cm.

b) Attachment Means

The attachment means is connected to the support element and configured to attach said support element to the table.

The connection of the attachment means to the support element can be carried out in a number of different manners, as disclosed in more detail further down in the present document. As to the attachment of the support element to the table, said attachment can also be carried out in a number of different manners such as those disclosed below, thereby ensuring that the support element does not fall or move from its natural position of use while the user is sitting at the table.

The attachment means is specifically configured for attaching the elastic support element to the table. The attachment of the support element to the table is advantageous because it allows the user to freely move around without the support element being attached to him/her all the time. Since the support element remains in position, when returning to the table the user needs only to sit naturally. The attachment means with the table can also adopt a number of different configurations provided the connection is firm and secure.

Furthermore, the attachment means is connected to the elastic support element in a dismountable manner. This configuration allows for the attachment means to be disconnected from the support element to be replaced if necessary, for example due to excessive wear or for other cause.

In particular, according to a preferred embodiment of the invention, the attachment means comprises an attachment pad connected to the elastic support element by means of a pin passing through a first hole of the attachment pad and through a second hole of the elastic support element. The attachment pad further has an outer face having adhesives for attachment to the table.

In this context, naturally the pin has a rear flange having a larger diameter than the body, such that the body passes through the first hole but the rear flange does not.

In this manner, the posture corrector can be easily mounted just by passing the pin through the first hole of the attachment pad and then by inserting it in the second hole of the elastic support element. Optionally, the second hole could be the hole through which the elastic support element is inflated, in which case the pin acts as a plug for said second hole. In any case, the attachment pad is sufficiently flexible to adapt to the shape of the edge of the table. As to its shape, the attachment pad could have any shape, such as e. g. circular, square, rectangular, or the like.

In another preferred embodiment, the attachment means may be connected to the elastic support element by means of a first flexible sheet having a suction pad and/or adhesives. More preferably, the attachment means comprises a clamp having arms configured to grasp the edge of the table. Naturally, a posterior end of the clamp, that is, the end opposite to the free end of the arms, will be fixed to the flexible sheet mentioned above. Thereby, the posterior end of the clamp would be connected to the elastic support element by means of the suction pad and/or adhesive. With this configuration, the user would only have to open the arms of the clamp in a suitable manner depending on the clamp open/close mechanism and, thereafter, attach the clamp to the edge of the table at the position where he/she is going to sit. The elastic support element would therefore be attached to the table in a simple and secure manner.

The clamp arm closing mechanism may be implemented in any way provided a suitable pressure is exerted against the table so that it does not let go inadvertently. For example, the clamp may comprise a closing mechanism by means of springs biasing the arms one against the other to clamp the edge of the table. Alternatively, the clamp may comprise a closing mechanism by means of a worm gear that, when actuated, causes the arms to move one against the other to clamp onto the edge of the table.

In any case, to prevent damages in the table when clamping onto it, an inner face of the ends of the arms of the clamp comprises a padded sheet.

On the other hand, the attachment means may also comprise a joint provided between the clamp and the elastic support system to allow the user to move. The joint is configured for allowing relative angular displacements between the attachment means and the elastic support element, such as those taking place when the user moves when changing posture while sitting at the table. Tension in the attachment means making the posture corrector of the invention uncomfortable or possibly even causing breakage of a component thereof are thereby prevented As an alternative to the clamp disclosed in the above paragraphs, said attachment means comprises a second flexible sheet having an adhesive face configured to adhere to the edge of the table. That is, in this case the attachment means would comprise two flexible sheets: a first flexible sheet configured to be connected to the elastic support element by means of vacuum and/or adhesives, and the second flexible sheet configured to be attached to the edge of the table by adhesives. Thereby, after connecting the attachment means to the elastic support element by means of the first flexible sheet as disclosed above, the user would only need to attach the second flexible sheet to the edge of the table by means of the adhesive. The elastic support element would thus be attached to the table in a simple and secure manner.

According to a particularly preferred embodiment of the invention, to allow for user movement, the attachment means may additionally comprise an elastic connection element between the first flexible sheet for connection to the elastic support element and the second flexible sheet for attachment to the edge of the table. This elastic connection means carries out a function equivalent to the joint disclosed above by allowing for relative rotation between the first and second flexible sheets.

The posture corrector disclosed in the above paragraphs, therefore, solves the problem in a simple manner. Although not explicitly disclosed in this document, changes or alternatives in the posture corrector of the present invention are possible within the scope of protection disclosed in the attached claims.

DESCRIPTION OF A PREFERRED EMBODIMENT

A number of exemplary embodiments of the posture corrector (1) according to the present invention are now disclosed with reference to the attached drawings.

Figure 18:
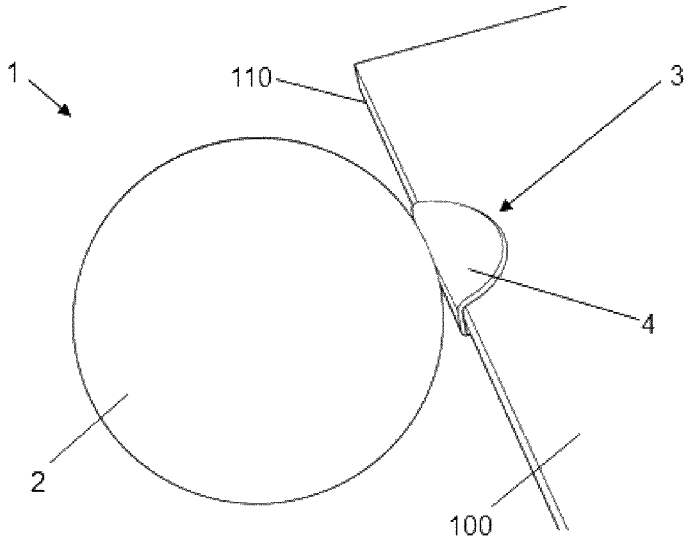
FIG. 18 shows another perspective view of the fourth exemplary posture corrector attached to a table.

The elastic support element (2) shown in all figures except for FIG. 18 is shaped as an inflatable balloon having a diameter between 15 cm and 25 cm. The inflatable balloon (2) has an orifice (21) with a valve for filling and emptying. Note that the orifice (21) needs not be provided exactly in the position shown in the figures, but it can be positioned anywhere in the inflatable balloon (2).

In the following, each of the exemplary embodiments is disclosed in more detail.

First Example

FIGS. 1-5 show different views of a first exemplary posture corrector (1) according to the invention. The attachment means (3) of this first exemplary posture corrector (1) is configured to be attached to the table (100).

The first exemplary corrector (1) is formed by an attachment means (3) shaped as a clamp that is connected to the inflatable balloon (2). Particularly, the clamp comprises two arms (32) connected in an articulated manner to a common base, such that they alternate between an open position where they are separated one from the other and a closed position where the free ends are adjacent one to the other. The shape of the arms may change, although in this example it is curved to avoid contact with the table (100) and, thereby, prevent damages such as scratches and the like. Inside the base where the arms (32) are connected there are one or more springs configured to continuously bias the arms (32) towards the closed position. The arms (32) also have fins (37) acting as handles for the user to pull outwards from both arms (32) for opening them when making the clamp move from the closed position to the open position.

At the free end of each arm (32) there is a plate (36) that is articulated to the corresponding free end to ensure a correct support against the surface of the table (100). On the surface of the plate (36) intended to abut against the surface of the table (100) there is a padded sheet (34) for preventing damage. Thereby, to attach the attachment means (3) to the table (100), the user needs only to pull from the fins (37) to make the arms (32) move from to open position, place the clamp such that the table (100) is positioned between both arms (32), and let go of the fins (37) such that the spring or springs automatically cause the arms (32) to move towards the closed position, thereby grasping the table (100) between them.

The attachment means (3) of this first example also has a first flexible sheet (31) for connecting the attachment means (3) to the inflatable balloon (2). In this specific example, the first flexible sheet (31) is connected to a posterior surface of the base of the clamp. The shape of the first flexible sheet (31) is that of a spherical cap having the cavity oriented in a direction opposite the clamp to adapt to the spherical shape of the inflatable balloon (2). This first flexible sheet (31) can be connected to the inflatable balloon (2) in the manner of a suction cap. To improve the connection, it is possible to provide a zone having and adhesive in the inflatable balloon (2) on the place where the first flexible sheet (31) is attached.

Figure 1:
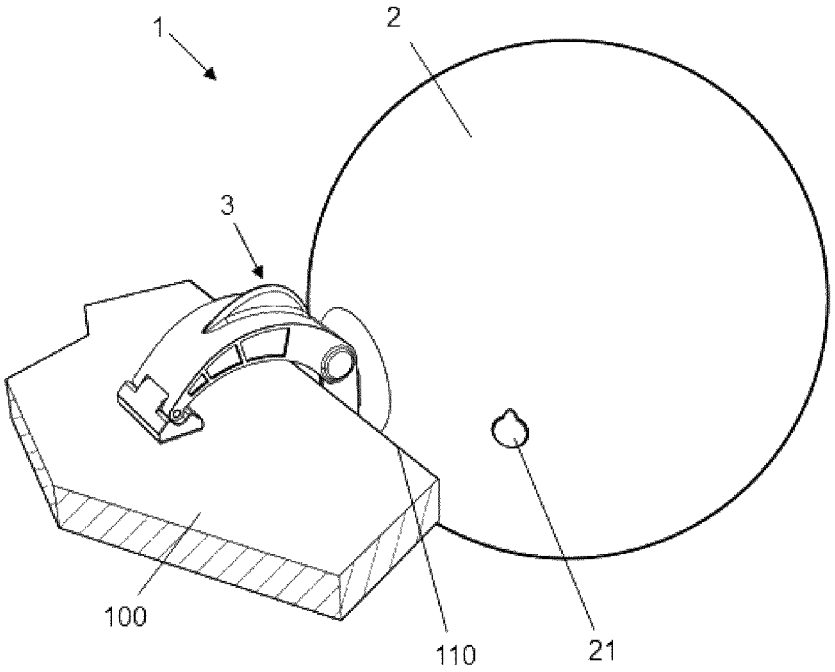
FIG. 1 shows a perspective view of a first exemplary posture corrector according to the invention attached to a table.
Figure 2:
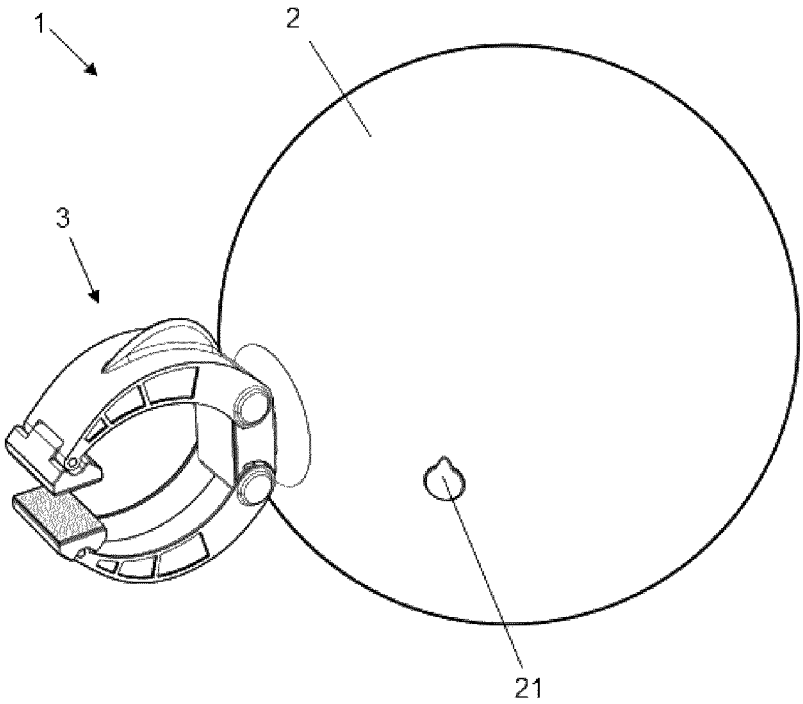
FIG. 2 shows another perspective view of the first exemplary posture corrector according to the invention when not attached to the table.
Figure 3:
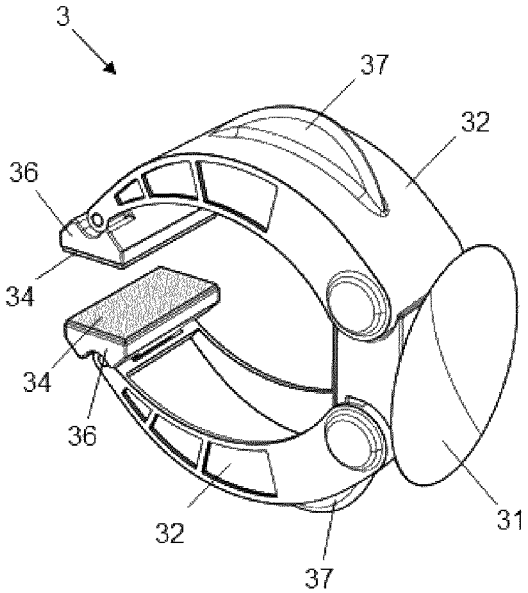
FIG. 3 shows a perspective view of the attachment means of the first exemplary posture corrector according to the invention.
Figure 4:
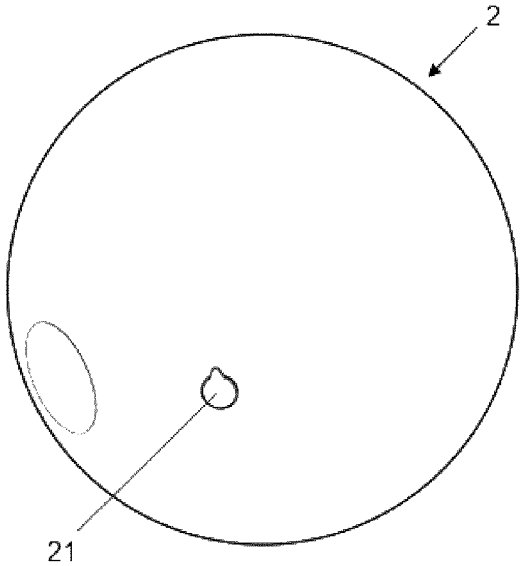
FIG. 4 shows a perspective view of the elastic support element of the first exemplary posture corrector according to the invention.
Figure 5:
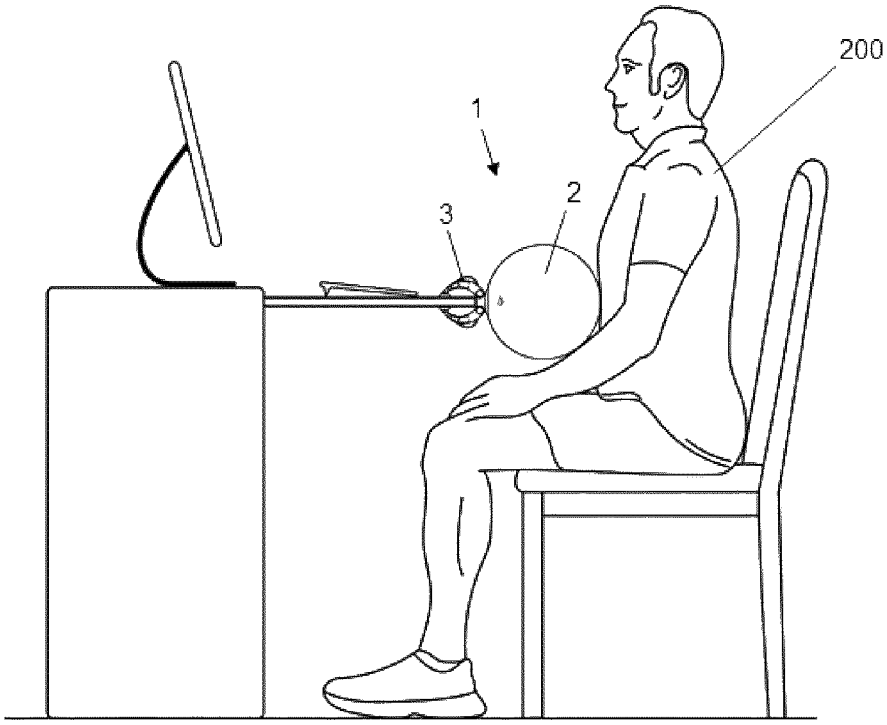
FIG. 5 shows a schematic lateral view of the use of the first exemplary posture corrector according to the invention.
Figure 6:
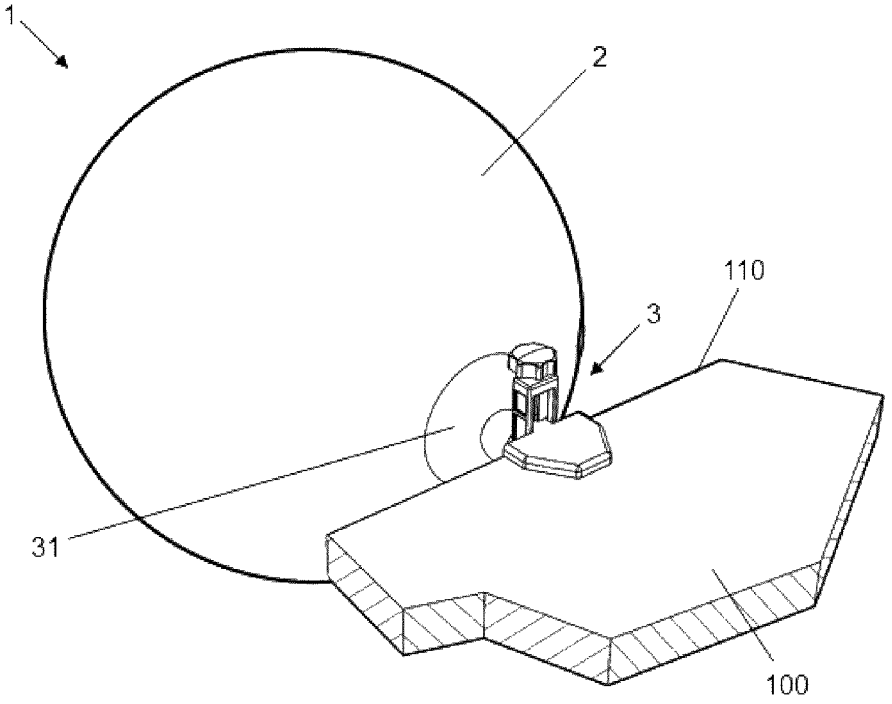
FIG. 6 shows a perspective view of a second exemplary posture corrector according to the invention attached to a table.
Figure 7:
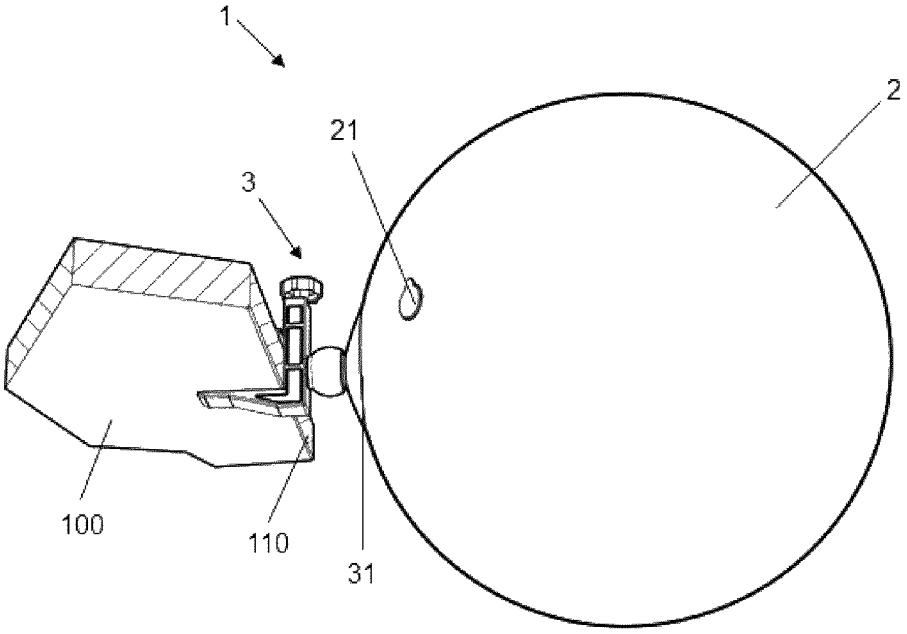
FIG. 7 shows another perspective view of the second exemplary posture corrector according to the invention attached to the table.
Figure 8:
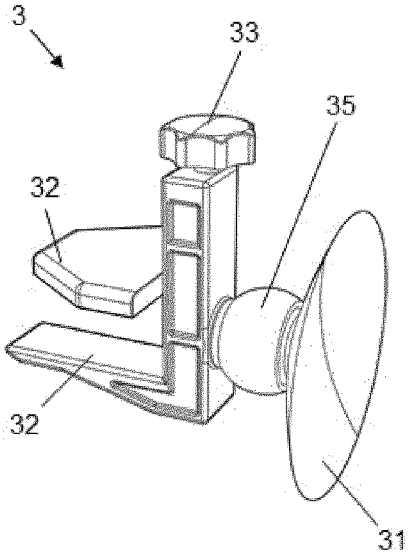
FIG. 8 shows a perspective view of the attachment means of the second exemplary posture corrector according to the invention.
Figure 9:
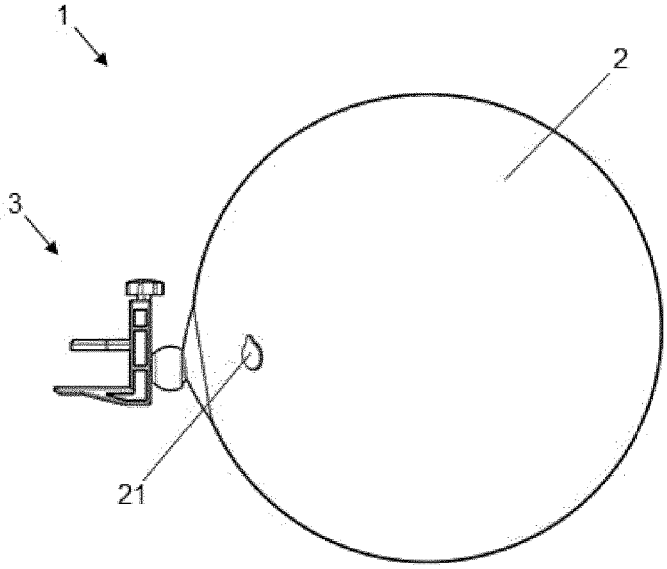
FIG. 9 shows a lateral view of the second exemplary posture corrector according to the invention.

FIG. 5 shows this first posture corrector (1) during use. The inflatable balloon (2) is connected to the attachment means (3) by means of the first flexible sheet (31) by means of an adhesive. The user then opens the clamp of the attachment means (3) and attaches it to the table (100). The inflatable balloon (2) is thereby also attached to the table (100), and the user (200) only needs to sit and slightly abut his/her abdomen against said inflatable balloon (2).

Second Example

FIGS. 6-10 show a number of views of a second exemplary posture corrector (1) similar to that shown in FIGS. 1-5. As shown, the attachment means (3) of this second exemplary posture corrector (1) is also configured to be attached to the table (100).

Indeed, this second exemplary posture corrector (1) also comprises an attachment means (31) configured as a clamp having two arms (32) alternating between open and closed positions. However, the opening and closing mechanism of the clamp is different here, since it is based on a worm gear (33) that, when actuated, causes one of the arms (32) to move relative the other, making them move closer or farther away depending on the rotation direction. Note that in the figures only the actuated end of the worm gear (33) is shown, the worm gear (33) being housed within a base to which the arms (32) are connected.

This attachment means (3) also comprises a first flexible sheet (31) for connection with the inflatable balloon (2). The first flexible sheet (31) is similar to that disclosed with respect to the first posture corrector (1), shaped as a spherical cap and, optionally, provided with an adhesive to improve the connection to the inflatable balloon (2). However, unlike in the previous example, the connection between the clamp and the first flexible sheet (31) is carried out here by means of a joint (35). The joint (35) allows for relative rotations between these two components such that, assuming the clamp is attached to the table (100), the inflatable balloon (2) can move rotating around the joint (35) in one or the other direction to follow the movements of the user (200) when changing posture.

Figure 10:
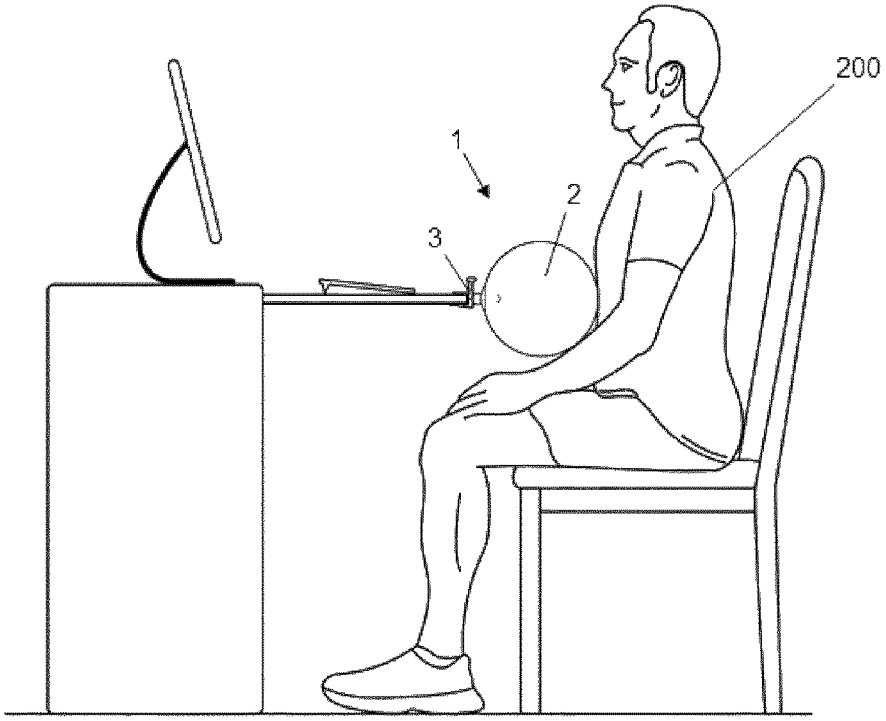
FIG. 10 shows a lateral schematic view of the us of the second exemplary posture corrector according to the invention.
Figure 11:
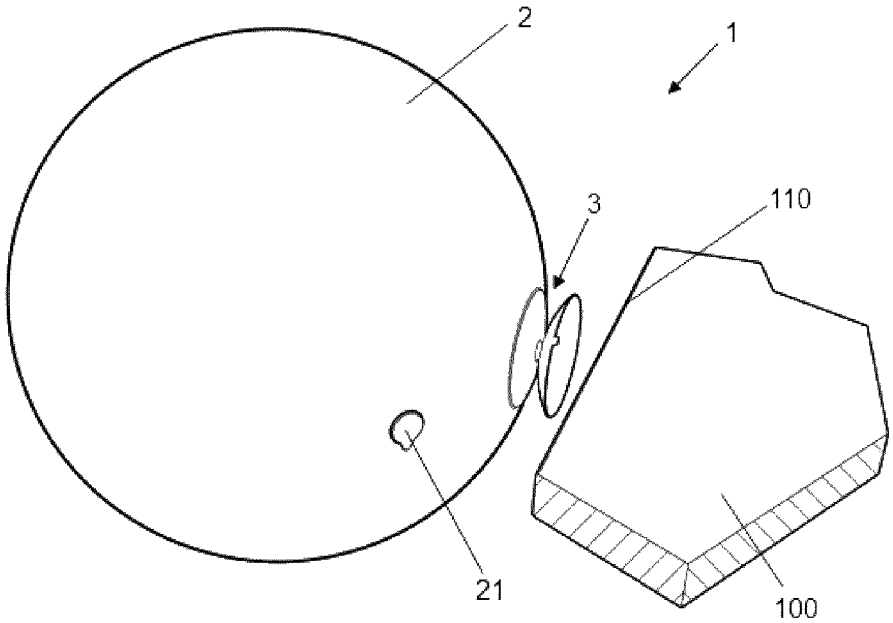
FIG. 11 shows a perspective view of a third exemplary posture corrector according to the invention attached to a table.

FIG. 10 shows the posture corrector (1) of this second example during use. Its installation is equivalent to that disclosed in connection to the first example, however in this case the user does not pull the arms (32) manually outwards, but he/she rotates the worm gear (33) until the arms (32) clamp the table (100). The inflatable balloon (2) is thereby attached to the table (100) to aid the user sit upright.

Third Example

FIGS. 11-15 show a number of views of a third exemplary posture corrector (1) according to the invention. As shown, the third exemplary attachment means (3) is also configured to be attached to the table (100).

Specifically, the attachment means (3) of this third exemplary posture corrector (1) comprises the first flexible sheet (31) joined to a second flexible sheet (38) by means of an elastic connection element (39). As mentioned above, the first flexible sheet (31) allows for connecting the attachment means (3) to the inflatable balloon (2), and it also has a spherical cap shape. Adhesives or vacuum can be employed for connecting the first flexible sheet (31) to the inflatable balloon (2). The second flexible sheet (38) of this example is similar to the first, that is, it has a circular or spherical cap shape, although in both cases other shapes would be possible, such as square or rectangular shapes. Both flexible sheets (31, 38) are oriented such that their cavities are oriented in opposite directions. The elastic connection element (39) connecting one to the other allows for relative rotations of one with respect to the other to ensure that the inflatable balloon (2) can follow small movements of the user (200) when changing posture. The second flexible sheet (38) additionally comprises, on its outwardly facing face, an adhesive or the like to allow for fixation to the table (100). Further, to facilitate separation from the table (100), the second flexible sheet (38) further has a tab (T) that protrudes from the lateral edge of the sheet (38). This tab (T) does not have any adhesive of form part of the surface making up the suction cup, such that it is easy to pull from it to separate the second flexible sheet (38) from the surface of the table (100).

Figure 12:
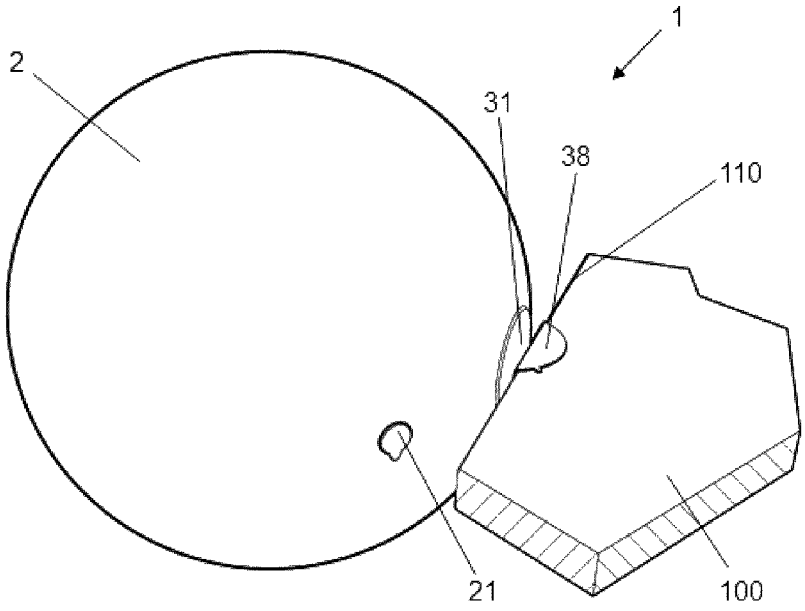
FIG. 12 shows another perspective view of the third exemplary posture corrector according to the invention attached to the table.
Figure 13:
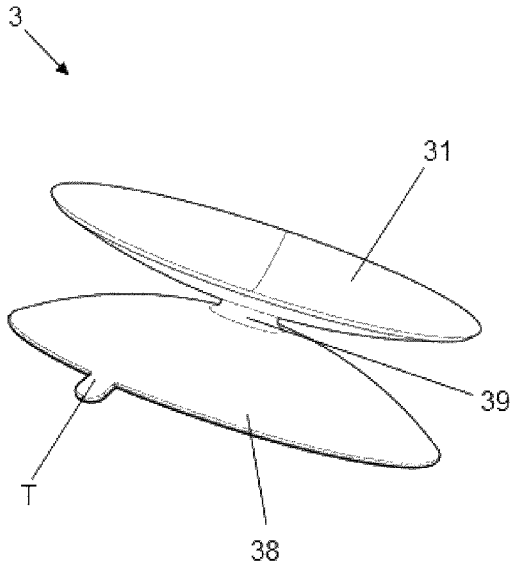
FIG. 13 shows a perspective view of the attachment means of the third exemplary posture corrector according to the invention.
Figure 14:
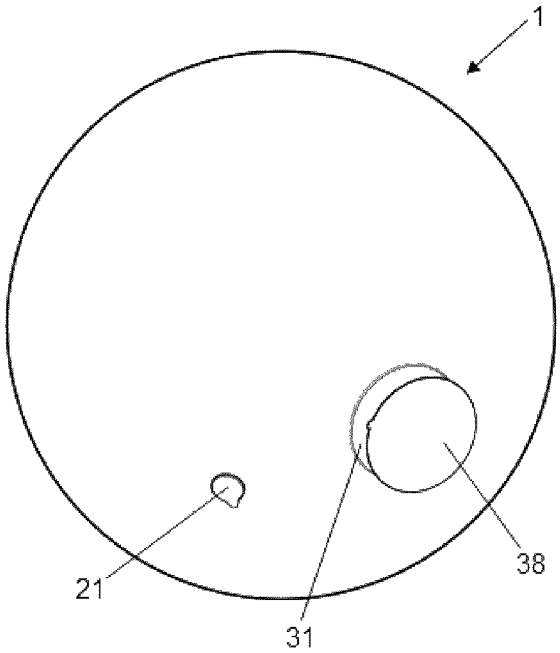
FIG. 14 shows another perspective view of the third exemplary posture corrector according to the invention.
Figure 15:
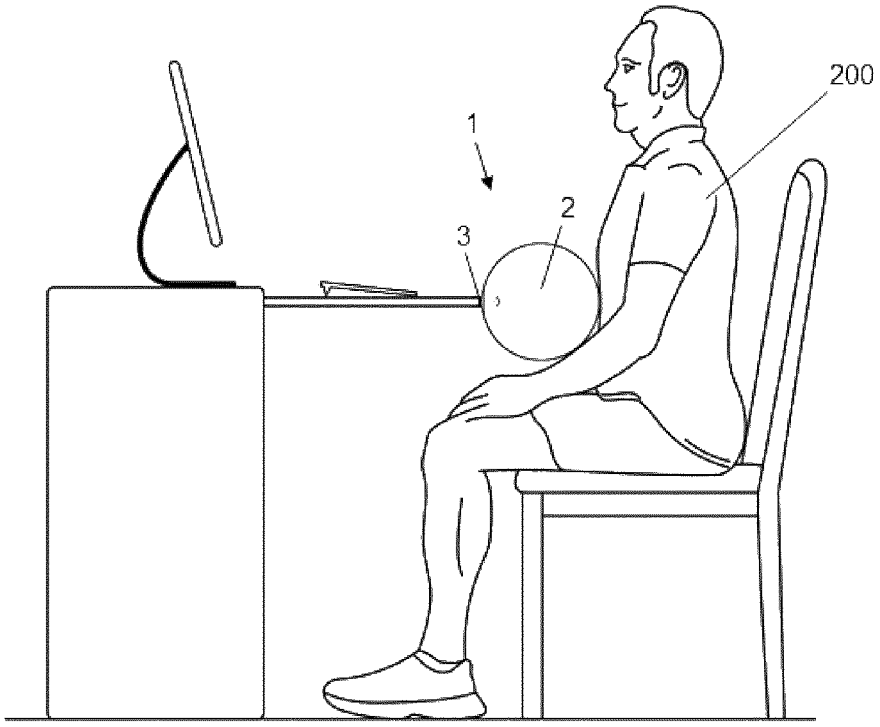
FIG. 15 shows a schematic lateral view of the use of the third exemplary posture corrector according to the invention.

Therefore, as shown in FIG. 12, to attach the posture corrector (1) to the table, the user needs only to bring the second flexible sheet (38) towards the edge (110) of the table (100) and fold it by pressing firmly against its surface. Thanks to the adhesive, the surface of the outwardly oriented face is attached to the table (100). The inflatable balloon (2) is thereby attached to the table (100) and ready to be used.

Fourth Example

Figure 16:
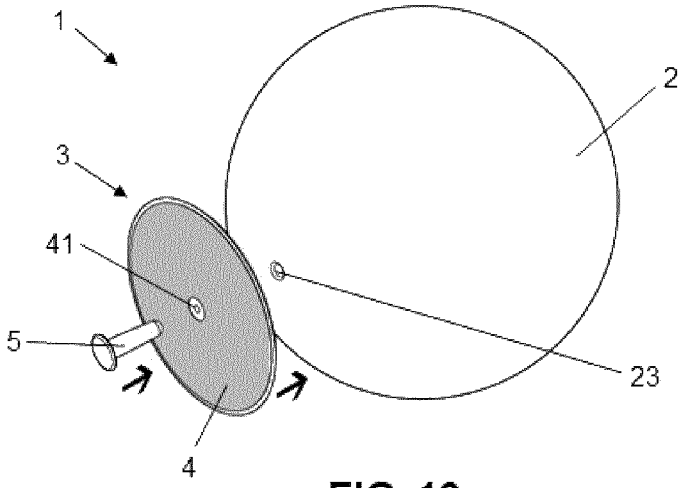
FIG. 16 shows a perspective view of a dismounted fourth exemplary posture corrector according to the invention.
Figure 17:
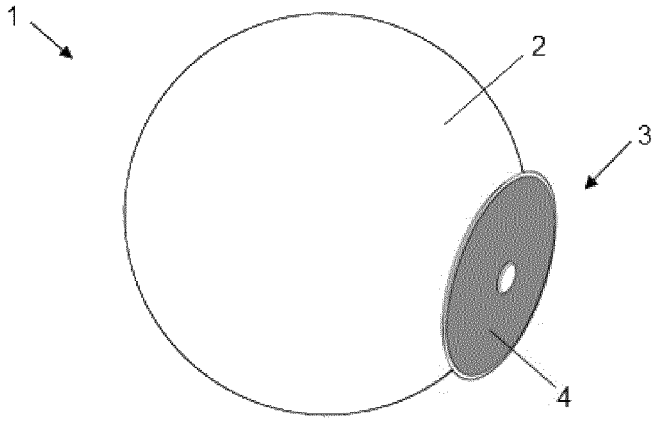
FIG. 17 shows another perspective view of the fourth exemplary posture corrector according to the invention.

FIGS. 16-18 show still one more example of the posture corrector (1) of the invention. The corrector (1) comprises an inflatable balloon (2) and an attachment means (3) dismountably connected thereto.

The attachment means (3) comprise an attachment pad (4) having a circular shape and a first hole (41) in the centre. A pin (5) is further provided for connecting the attachment pad (4) to the inflatable balloon (2). In particular, as shown in FIG. 16, the pin (5) is inserted through the first hole (41) of the attachment pad (4) and through a second hole (23) of the inflatable balloon (2). The attachment pad (4) is flexible, and an outer face thereof, i.e. the face opposite the inflatable balloon (2) has an adhesive. Thereby, the attachment pad (4) can be folded around the edge (110) of the table (100) and adhered thereto as shown in FIG. 18.

The invention claimed is:

1. A posture corrector (1) for causing a user sitting in front of a table (100) to adopt a correct posture, comprising:

an elastic support element (2) for the abdomen of the user configured to be provided between an abdomen of the user and a front edge (110) of a table (100); and an attachment means (3) dismountable connected to the support element (2), where the attachment means (3) is configured to attach the support element (2) to the table (100), characterized in that the elastic support element (2) is an spherical inflatable balloon, and in that the attachment means (3) comprises an attachment pad (4) connected to the inflatable balloon by means of a pin (5) passing through a first hole (41) of the attachment pad (4) and through a second hole (23) of the inflatable balloon, where the second hole (23), is the hole through which the inflatable balloon is inflated, the pin (5), acting as a plug closing said second hole (23), the attachment pad (4) further having an outer face having adhesives for attachment to the table (100).

2. The posture corrector (1) according to claim 1, where the inflatable balloon has a diameter of between 15 cm and 25 cm.

3. The posture corrector (1) according to claim 1, where attachment pad (4) is circular.

4. A method for mounting a posture corrector (1) according to claim 1, characterized by comprising the following steps:

passing the pin (5) through the first hole (41) of the attachment pad (4); and inserting the pin (6) into the second hole (23) of the inflatable balloon, thereby plugging said second hole (23).

* * * * *